US005107390A

United States Patent [19]

Goldner

[11] Patent Number: 5,107,390

[45] Date of Patent: Apr. 21, 1992

[54] SHELL-FORM TRANSFORMER IN A BATTERY POWERED IMPACT DEVICE

[75] Inventor: Sandor Goldner, Brooklyn, N.Y.

[73] Assignee: Arrow Fastener Company, Inc., Saddle Brook, N.J.

[21] Appl. No.: 621,225

[22] Filed: Nov. 30, 1990

[51] Int. Cl.[5] ..... H01H 47/00; H01F 27/30

[52] U.S. Cl. ..... 361/156; 336/178; 336/182

[58] Field of Search ..... 336/178, 180, 185, 165, 336/212, 182; 361/156, 160

[56] References Cited

U.S. PATENT DOCUMENTS

| | | | |
|---|---|---|---|
| 2,261,323 | 11/1941 | Zierdt | 336/165 |
| 2,694,177 | 11/1954 | Sola | 336/165 |
| 3,546,571 | 12/1970 | Fletcher et al. | 336/165 |
| 3,803,479 | 4/1974 | Ratnor | 336/212 |
| 4,305,056 | 12/1981 | Mochida et al. | 336/178 |
| 4,319,837 | 3/1982 | Marshall | 336/178 |
| 4,356,468 | 10/1982 | Van Laar | 336/178 |
| 4,639,706 | 1/1987 | Shimizu | 336/185 X |
| 4,763,094 | 8/1988 | Kojima | 336/178 |

FOREIGN PATENT DOCUMENTS

| | | | |
|---|---|---|---|
| 1368254 | 9/1974 | United Kingdom | 336/178 |

*Primary Examiner*—Thomas J. Kozma

*Attorney, Agent, or Firm*—Fitzpatrick, Cella, Harper & Scinto

[57] ABSTRACT

A shell-form transformer for charging an energy storage device contained in a battery powered impact device. The primary and secondary windings of the transformer are wound in a predetermined manner around the center leg of a core which has an air gap therein. The gap increases the reluctance of the center leg which decreases the flow of magnetic flux through the core which, in turn, enables the current applied to the transformer primary to be increased without causing the core to be saturated. As a result, the current applied to the transformer primary can be increased, thereby increasing the output voltage supplied from the transformer secondary which, in turn, enables rapid charging of the energy storage device.

7 Claims, 3 Drawing Sheets

FIG. 4
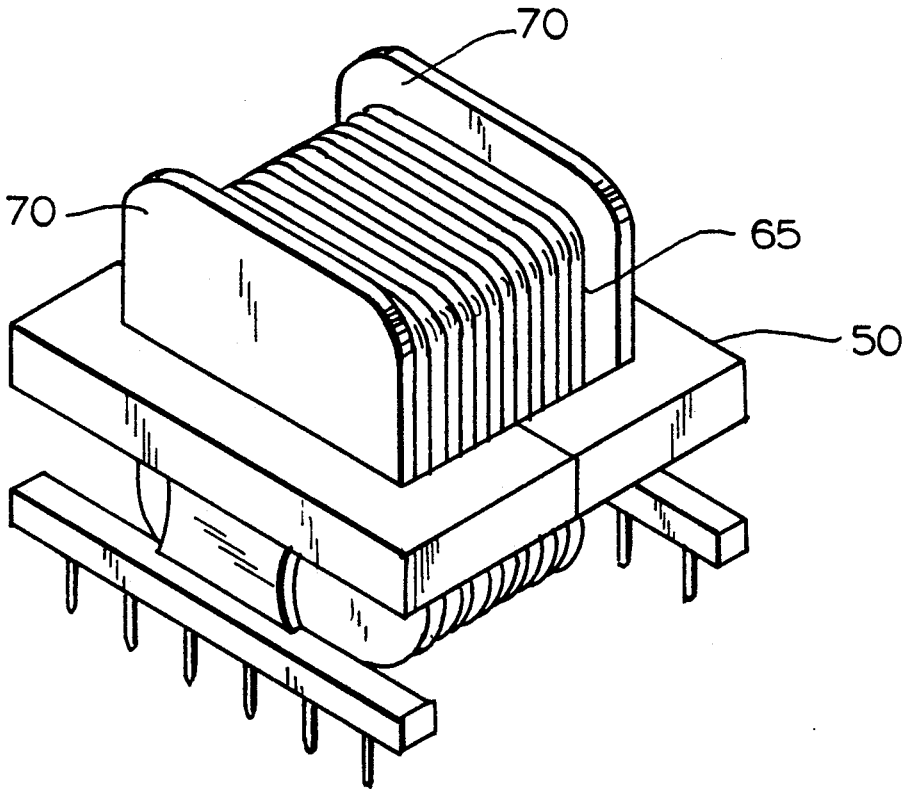
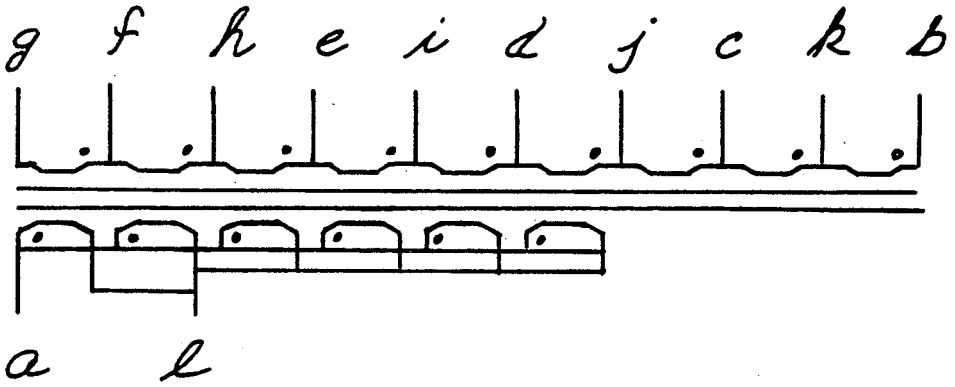
FIG. 5

SHELL-FORM TRANSFORMER IN A BATTERY POWERED IMPACT DEVICE

BACKGROUND OF THE INVENTION

1. Field of the Invention

This invention relates to a shell-form transformer and, more particularly, to a shell-form transformer for charging an energy storage device in a battery powered impact device in which the primary and secondary windings are wound in a predetermined manner around a center leg having an air gap therein.

2. Description of the Prior Art

Transformers are capable of stepping up or stepping down alternating voltages. As is elementary, two or more coils, each having a plurality of turns, are arranged in the transformer so that mutual inductance exist between the coils. Energy is transferred from a primary winding or coil to a secondary winding or coil by a mutual magnetic field. A core, typically fabricated from an iron alloy, links the windings and provides a high-permeance path for the mutual magnetic flux.

The iron-alloy core is normally made up of a plurality of laminations in which each lamination is insulated from the others by an insulating coating, such as iron oxide. The laminations prevent the formation of large eddy currents by reducing the paths for such currents. Without such laminations, the resultant eddy currents would cause excessively high core heating and a significant reduction in transformer efficiency.

FIG. 1 illustrates a shell-form transformer 1 according to the prior art in which primary and secondary windings 10 are wound on a center leg 15 of a core 5. As shown, no windings are wound around the outer two legs 20 and 25. Typically, the low-voltage winding is wound closer to the center leg so as to minimize the amount of insulating material required for the coils. In core 5, mutual flux flows through center leg 15 and each of the outer two legs 20 and 25 serves as a return path for half of the mutual flux. As such, the cross-sectional area of center leg 15 is approximately twice that of each outer leg 20 and 25.

Battery powered devices, for example, battery powered electric staplers or the like, use transformers to step-up an applied voltage to a predetermined value. For example, in a pending U.S. Patent Application assigned to the present Assignee, entitled "Apparatus for Driving the Armature of an Electric Stapler", S. Goldner, Ser. No. 07/486,247, filed on Feb. 28, 1990, which is incorporated herein by reference, a step-up transformer is utilized to charge an energy storage device or capacitor which, when fully charged and triggered, drives an armature causing a staple to discharge. In this application, it is desirable to transform an applied input voltage of approximately 5–15 volts to a voltage level in the range of approximately 150 to 300 volts. It is to be appreciated, that by maximizing the transformer output voltage as described, the time required to charge the capacitor is minimized which, in turn, enables rapid continuous discharging of the staples.

The output voltage of a transformer is typically increased by increasing the applied current. However, the maximum current which can be applied to a transformer is limited by core saturation, wherein further increases in the applied current fail to produce an increase in the core flux density. As is to be appreciated, core saturation reduces the transformer operating efficiency and limits the output voltage from the transformer secondary. Therefore, to increase the transformer output voltage beyond the limit imposed by core saturation (which would increase the charging rate of the capacitor used in the electric stapler of the referenced application), the size of the core must be increased. As a result, the size and cost of the transformer, and thus the electric stapler, are increased. The prior art has failed to provide a transformer having a satisfactorily small size which is inexpensive and, when used with an electric stapler or the like, enables rapid charging of an energy storage device therein.

OBJECTS AND SUMMARY OF THE INVENTION

An object of the present invention is to provide a shell-form transformer for charging an energy storage device contained in a battery powered impact device which overcomes the foregoing problems associated with the prior art.

Another object of this invention is to provide a shell-form transformer as aforementioned wherein the center leg of the core has a gap for decreasing the flow of magnetic flux in the core which enables the applied current to be increased without causing core saturation.

An additional object of the present invention is to provide a shell-form transformer as aforementioned having a core with a gap in the center leg in which the gap opening, the size of the wire used for the primary and the secondary windings, and the number of turns of the windings all cooperate to prevent core saturation, minimize back electromotive force (emf) and improve the operating efficiency of the shell-form transformer.

Other objects, features and advantages according to the present invention will become apparent from the following detailed description of an illustrated embodiment when read in conjunction with the accompanying drawings in which corresponding components are identified by the same reference numerals.

In accordance with this invention, a shell-form transformer is provided for charging an energy storage device in a battery powered impact device comprising: a core structure having two outside legs and a center leg with a gap therein, a primary winding having a plurality of coils wound around the center leg for receiving energy in a first state, and a secondary winding having a plurality of coils wound around the center leg for supplying energy in a second state to the energy storage device, thereby charging the energy storage device.

BRIEF DESCRIPTION OF THE DRAWINGS

FIG. 4 is a perspective view of the shell-form transformer of FIGS. 3A, 3B and 3C; and FIG. 5 is a schematic diagram of the shell-form transformer of FIGS. 3A, 3B and 3C.

DETAILED DESCRIPTION OF A PREFERRED EMBODIMENT

An improved shell-form transformer according to the embodiment of the present invention will now be described with reference to FIGS. 2–4.

Figure 1:
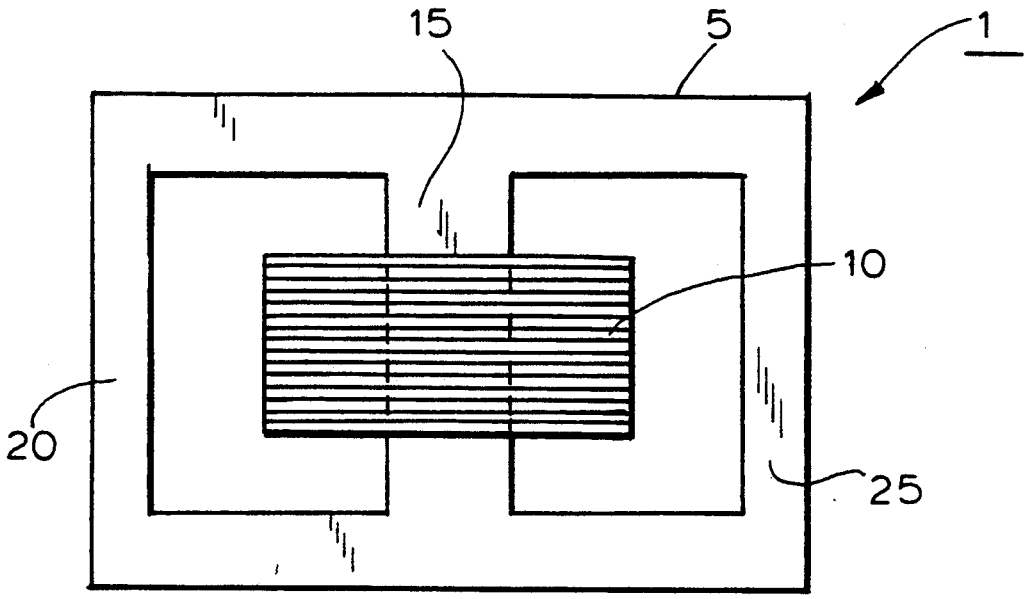
FIG. 1 PRIOR ART
FIG. 1 illustrates a shell-form transformer according to the prior art.
Figure 2:
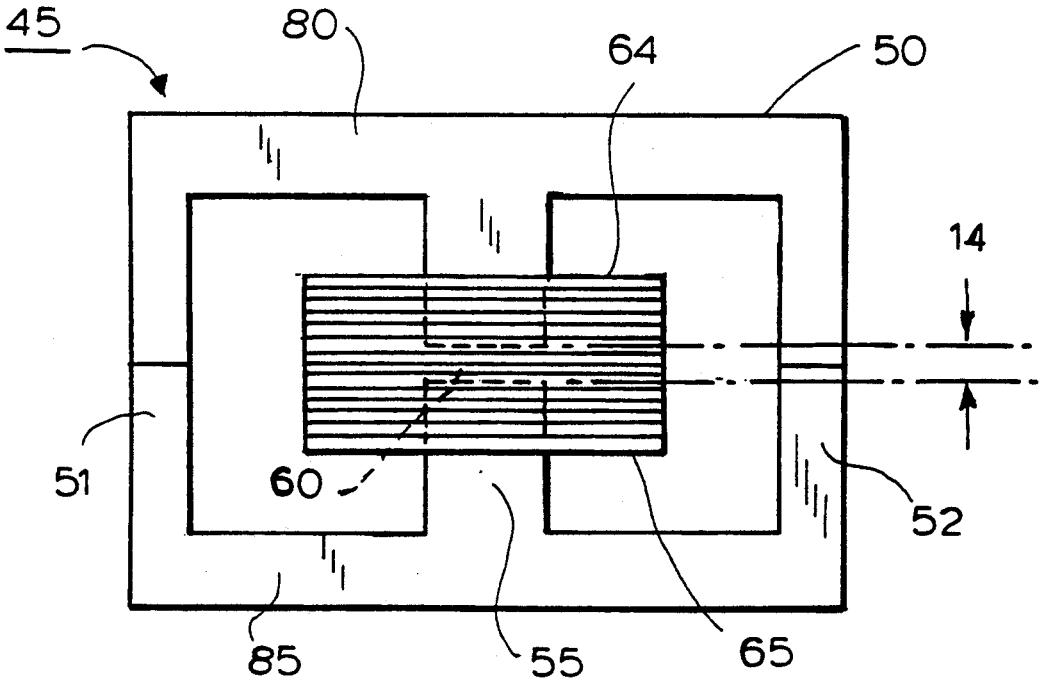
FIG. 2 illustrates one embodiment of a shell-form transformer according to the present invention.
Figure 3A:
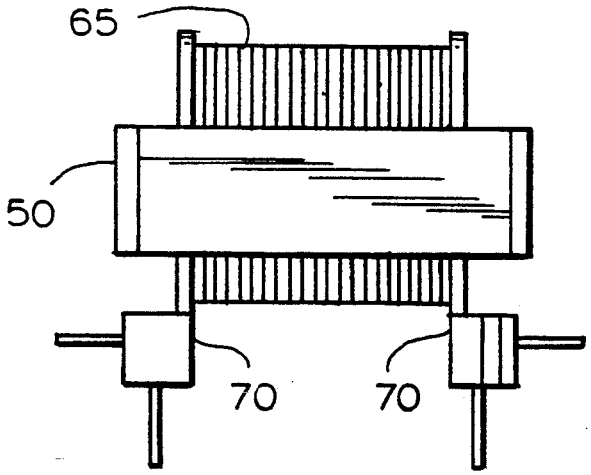
FIGS. 3A, 3B and 3C illustrate side, front and bottom views, respectively, of a shell-form transformer according to an embodiment of the present invention.
Figure 3B:
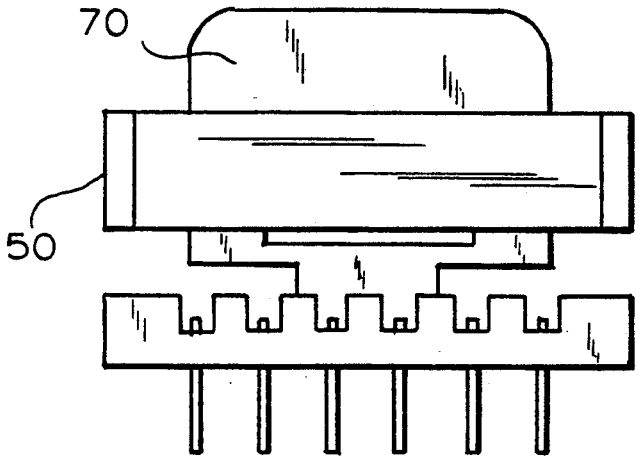
Figure 3C:
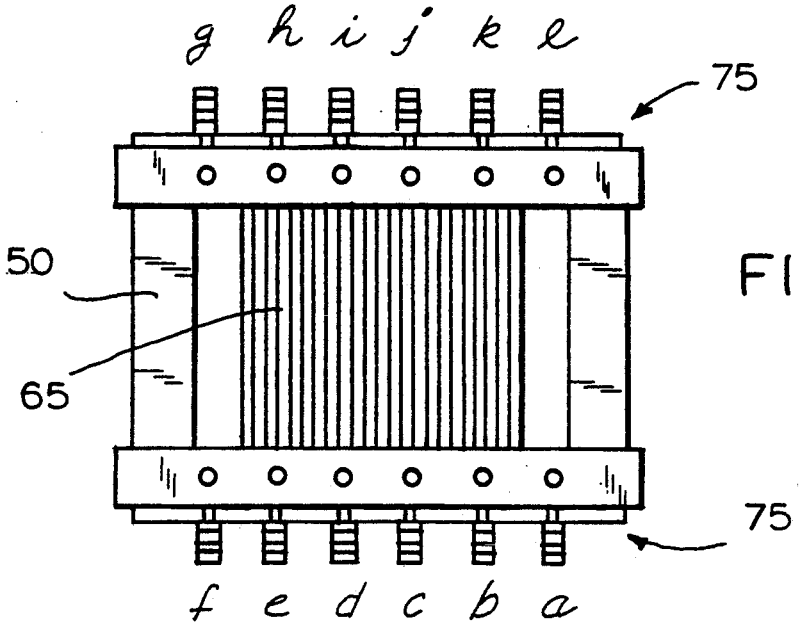

FIG. 2 illustrates a transformer 45 which is generally comprised of a core 50 and primary and secondary windings 64 and 65, respectively. Core 50 includes outer legs 51 and 52 and a center leg 55, which contains an air gap 60 having a predetermined height H. Core 50 is preferably fabricated from an iron-alloy and comprises a plurality of laminations, in which each lamination is insulated from adjacent laminations. Primary winding 64 and secondary winding 65 are wound around center leg 55, wherein the low-voltage winding, that is, the winding across which is applied the lower voltage, is wound closer to the center leg. In a preferred embodiment as, for example, when used in the electric stapler described in the aforereferenced application, the primary winding 64 is the low-voltage winding and, as such, is wound closer to center leg 55.

As in the prior art transformer, a current applied to primary winding 64 causes a magnetic flux to be developed which flows through core 50 and links primary winding 64 to secondary winding 65. As a result, an electromotive force (emf) is induced in secondary winding 65. As previously described, the flow of magnetic flux in the core is limited by the core saturation which, in turn, limits the induced emf. However, by placing air gap 60 in center leg 55 as shown in FIG. 2, core saturation is prevented from occurring for an applied current having an amplitude which would have caused a saturation condition to occur in a similarly sized core without an air gap. More specifically, air gap 60 increases the reluctance of center leg 55 which decreases the flow of magnetic flux, so that the applied current level may be increased above that of the prior art without saturating core 50. Thus, a correspondingly larger emf signal is produced from secondary winding 65.

The height H of air gap 60 (FIG. 2) is selected to produce a predetermined increase in the reluctance of center leg 55. In a preferred embodiment, air gap 60 ranges from approximately 0.010 to 0.130 of an inch.

FIGS. 3A, 3B, 3C and FIG. 4 illustrate transformer 45 in more detail. As shown, transformer 45 further includes support plates 70 and terminals 75. Preferably, there are twelve terminals, identified as a, b, c... k, 1, which are arranged in two rows as shown. That is, each row includes six equally spaced terminals which are attached to one of the support plates 70. Support plates 70 are located between core 50 and windings 64 and 65 and, as such, are further adapted to contain windings 64 and 65 within the inner periphery of core 50. In a preferred embodiment, plates 70 are fabricated from a plastic-type material and, for example, may be model no. 1531A-31-80 manufactured by the Plastron Corporation.

As is to be appreciated, by increasing the reluctance through center leg 55, the operating efficiency of transformer 45 is slightly decreased. To compensate for this relatively small decrease in efficiency, primary winding 64 and secondary winding 65 are wound in a predetermined manner, as hereinafter explained.

In a preferred manner of winding primary winding 64 and secondary winding 65, fifteen segments of wire of predetermined gage, preferably 24 AWG solid wire, are each wound 13 times around center leg 55, wherein the respective ends of the segments are attached to individual ones of terminals a-1 as illustrated in the wire schematic of FIG. 5 and as described below:

| STEPS | PROCEDURE |
|---|---|
| 1 | Connect the ends of 6 wire segments to terminal a. Connect the 6 other ends of the wire segments attached to terminal a to terminal 1. |
| 2 | Connect the end of 1 wire segment to terminal b. Connect the other end of the wire segment attached to terminal b to terminal k. |
| 3 | Connect the end of 1 wire segment to terminal k. Connect the other end of the wire segment attached to terminal k to terminal c. |
| 4 | Connect the end of 1 wire segment to terminal c. Connect the other end of the wire segment attached to terminal c to terminal j |
| 5 | Connect the end of 1 wire segment to terminal j. Connect the other end of the wire segment attached to terminal j to terminal d. |
| 6 | Connect the end of 1 wire segment to terminal d. Connect the other end of the wire segment attached to terminal d to terminal i. |
| 7 | Connect the end of 1 wire segment to terminal i. Connect the other end of the wire segment attached to terminal i to terminal e. |
| 8 | Connect the end of 1 wire segment to terminal e. Connect the other end of the wire segment attached to terminal e to terminal h. |
| 9 | Connect the end of 1 wire segment to terminal h. Connect the other end of the wire segment attached to terminal h to terminal f. |
| 10 | Connect the end of 1 wire segment to terminal f. Connect the other end of the wire segment attached to terminal f to terminal g. |

Winding primary and secondary windings 64 and 65, respectively, around center leg 55 of core 50 as previously described, produces a transformer having a relatively high operating efficiency. For example, an efficiency greater than 90% may be obtained when the height H of air gap 60 is within the preferred range mentioned above. Thus, the previously mentioned decrease in efficiency due to the increase in reluctance through center leg 55 caused by air gap 60 is more than offset by the improved operating efficiency which permits the secondary voltage to increase with higher primary current. Further, the preferred winding method also minimizes the back electromotive force.

To facilitate the construction of transformer 45, core 55 may be comprised of two substantially identical E-shaped portions, that is, portions 80 and 85 as shown in FIG. 2. More specifically, transformer 45 may be constructed by attaching the respective ends of windings 64 and 65 to terminals 75 as previously described, placing the windings and support plates 70 onto center leg 55, and securing each half of core 50 together with, for example, a cement or epoxy, making certain to maintain the pre-selected air gap. Transformer 45 is then vacuumed varnished using, for example, isonel 31.

By selecting a height H for air gap 60 within the predetermined range of 0.010 to 0130 inches (FIG. 2), the reluctance through center leg 55 increases which allows an increased current to be applied to primary winding 64 without saturating core 50. Further, by winding primary and secondary windings 64 and 65, respectively, in the aforementioned predetermined manner, a transformer having a relatively high operating efficiency is obtained. As a result, the output voltage from secondary winding 65 is increased for a given input current. Thus, when the present transformer is used with the electric stapler of the referenced patent application, the energy charging device may be charged and re-charged faster, thereby permitting more rapid discharging of staples.

Although a preferred embodiment of the present invention has been described in detail herein, it is to be understood that this invention is not limited to that precise embodiment, and that modifications and variations may be effected by one skilled in the art without departing from the spirit and scope of the invention as defined by the appended claims.

I claim as my invention:

1. A shell-form transformer for charging an energy storage device in a battery powered impact device, said transformer comprising:

a core having two outside legs and a center leg; said center leg being thicker than the thickness of said outside legs and having a gap formed therein;

a primary winding wound around said center leg for receiving energy in a first state; said primary winding consisting of nine wire segments serially connected to ten primary terminals in the transformer with each wire being wound thirteen times about the center leg; and a secondary winding having a plurality of coils wound around said center leg over said primary winding for supplying energy in a second state to said energy storage device; said secondary winding consisting of six wire segments each of which is wound thirteen times about said center leg and has opposite ends respectively connected to a pair of secondary terminals in the transformer.

2. The shell-form transformer as defined in claim 1, wherein said wire segments have a predetermined wire gauge of 24 AWG.

3. The shell-form transformer as in claim 1, wherein said gap ranges from approximately 0.010 to 0.130 of an inch.

4. The shell-form transformer as defined in claim 1 wherein the energy in a first state received by said primary winding has a voltage level of approximately 5 to 15 volts, and wherein the energy in a second state supplied by the secondary winding has a voltage level in the range of approximately 150 to 300 volts.

5. The shell-form transformer as in claim 4, wherein said core means is constructed of an iron alloy.

6. The shell-form transformer as in claim 5, wherein said core means includes a plurality of laminations in which each of said laminations is insulated from adjacent laminations.

7. In a battery powered impact device having an energy storage device for driving an armature, the improvement comprising a shell-form transformer for charging said energy storage device including:

a core having two outside legs and a center leg; said center leg being thicker than the thickness of said outside legs and having a gap formed therein;

a primary winding wound around said center leg for receiving energy in a first state; said primary winding consisting of nine wire segments serially connected to ten primary terminals in the transformer with each wire being wound thirteen times about the center leg; and a secondary winding having a plurality of coils wound around said corner leg over said primary winding for supplying energy in a second state to said energy storage device; said secondary winding consisting of six wire segments each of which is wound thirteen times about said center leg and has opposite ends respectively connected to a pair of secondary terminals in the transformer.

* * * * *